US006726555B2

(12) United States Patent
Eisënblaetter

(10) Patent No.: US 6,726,555 B2
(45) Date of Patent: Apr. 27, 2004

(54) TOOL CARRIER

(75) Inventor: Gerd Eisënblaetter, Geretsried (DE)

(73) Assignee: Gerd Eisenblaetter GmbH, Geretsried (DE)

( * ) Notice: Subject to any disclaimer, the term of this patent is extended or adjusted under 35 U.S.C. 154(b) by 0 days.

(21) Appl. No.: 10/026,929

(22) Filed: Dec. 27, 2001

(65) Prior Publication Data

US 2003/0134584 A1 Jul. 17, 2003

(51) Int. Cl.[7] ..... B24D 11/02
(52) U.S. Cl. ..... 451/490; 451/536
(58) Field of Search ..... 451/490, 526, 451/532–534, 536–539

(56) References Cited

U.S. PATENT DOCUMENTS 5,201,149 A * 4/1993 Eisenblatter ..... 451/526
5,616,411 A * 4/1997 Barber et al. ..... 428/373
5,674,122 A * 10/1997 Krech ..... 451/536
6,059,850 A * 5/2000 Lise et al. ..... 51/297

FOREIGN PATENT DOCUMENTS

JP 59129671 A * 7/1984 ..... B24D/13/16

* cited by examiner

*Primary Examiner*—Lee D. Wilson
*Assistant Examiner*—David B. Thomas
(74) *Attorney, Agent, or Firm*—Baker & Hostetler LLP

(57) ABSTRACT

The invention pertains to a fiber-reinforced rotationally symmetrical tool carrier, a corresponding manufacturing method and a grinding tool. The tool carrier can be separably connected to a rotary drive and contains a tool receptacle surface for receiving a grinding, rough-grinding and/or polishing element. The tool carrier and the grinding tool contain a fiber reinforcement that consists at least partially of natural fibers.

20 Claims, 6 Drawing Sheets

TOOL CARRIER

FIELD OF THE INVENTION

The invention pertains to a rotationally symmetrical tool carrier that can be separably connected to a rotary drive, with a tool receptacle surface for receiving at least one grinding and/or polishing element, with a fiber reinforcement that consists at least partially of natural fibers, and with a binder for stabilizing the natural fibers. The invention also pertains to a woven fabric carrier for woven grinding and polishing fabrics, a woven grinding and polishing fabric and a blank for the aforementioned objects. The invention furthermore pertains to a method for manufacturing a tool carrier, a grinding or polishing tool, a woven fabric carrier and a blank of the previously described type.

BACKGROUND OF THE INVENTION

A fiber-reinforced rotationally symmetrical tool carrier of this type can be separably connected to a rotary drive and contains a tool receptacle surface for receiving at least one grinding and/or polishing element.

In a material processing tool with a fiber-reinforced rotationally symmetrical tool carrier that can be separably connected to a rotary drive and contains a tool receptacle surface, at least one grinding and/or polishing element is received on the tool receptacle surface.

The rotationally symmetrical tool carrier may, for example, consist of a circular disk or a cylindrical roller.

The material processing tool may, for example, consist of a fan-type grinder, fan-type grinding brushes or rollers, rough-grinding wheels, cutting-off wheels, polishing wheels, etc.

Material processing tools of this type are used in instances in which the surfaces of arbitrary materials need to be processed, smoothed, polished and/or modeled. Generally speaking, this pertains to instances in which material needs to be removed from a workpiece. These tools are expendable parts that are manufactured and used in large quantities.

Material processing tools that consist of a rotationally symmetrical tool carrier, to which grinding and/or polishing elements are attached, are sufficiently known. The grinding and/or polishing elements may, for example, consist of felt-type polishing elements, grinding or polishing fleeces, woven grinding fabrics and the like.

In known material processing tools, the tool carrier is compactly manufactured from plastic such that it is rigid and resistant to bending, wherein fiber reinforcements, for example, glass fiber reinforcements, are also used. When using such material processing tools, the generated frictional heat may cause a significant temperature increase. This also increases the temperature of the tool carrier such that its rigidity and consequently its mechanical stability are reduced.

Based on these circumstances, the present invention aims to disclose objects of the initially described type, as well as a method for manufacturing said objects, wherein these objects can be easily manufactured, have favorable mechanical and thermal properties and, in addition, be harmlessly disposed of.

SUMMARY OF THE INVENTION

In a rotationally symmetrical tool carrier, this objective is attained due to the fact that the binder consists of polyurethane, polypropylene, phenol resin, epoxy resin or biological polymer.

In a woven fabric carrier for woven grinding and polishing fabrics and in a woven grinding or polishing fabric, as well as in a grinding or polishing tool with embedded abrasive grain, the objective of the invention is attained due to the fact that the respective object is at least partially manufactured from natural fibers.

It is particularly advantageous that the respective binder consist of lignin or be based on corn starch.

In a woven fabric, the objective of the invention is attained due to the fact that the natural fibers consist of one or more of the materials hemp, flax or sisal. Sisal, in particular, is very resistant to abrasion such that it generates an abrasive effect if the tool, woven fabric or woven fabric carrier manufactured thereof is used for grinding purposes.

According to one preferred additional development of the tool carrier, the woven fabric carrier and the woven fabric, the respective object is manufactured from a granulate that consists of natural fibers and a binder.

In a blank that is additionally processed into a tool carrier, a tool, a woven fabric carrier or a woven fabric of the aforementioned type, the objective of the invention is attained due to the fact that the respective object is manufactured from a fiber mat that consists at least partially of natural fibers and contains a binder for the natural fibers.

According to one preferred additional development of the blank, the blank is manufactured from at least two layers of a fiber mat that consists at least partially of natural fibers and contains a binder for the natural fibers, wherein the layers are placed on top of one another in a sandwich-like fashion and bonded to one another.

According to another preferred embodiment of the blank, abrasive grain is applied onto the surfaces of the fiber mats before the bonding process.

In a method for manufacturing a tool carrier, a grinding or polishing tool or a blank, the objective of the invention is attained due to the fact that a pulp consisting of natural fibers and a binder is produced, the fact that plate-shaped basic elements are produced from the pulp, the fact that the basic elements are compressed and shaped by means of a pressing tool in such a way that several blanks are formed adjacent to one another, and the fact that the blanks are subsequently punched out.

According to one advantageous additional development of this method, abrasive grain is added to and homogeneously distributed in the pulp such that the abrasive grain is uniformly distributed in the objects manufactured therefrom.

In a method for manufacturing a tool carrier, a grinding or polishing tool or a blank, the objective of the invention is alternatively attained due to the fact that a pulp of natural fibers is produced, the fact that mat-like basic elements are produced from the pulp, the fact that the basic elements are sprayed with a binder, the fact that the basic elements are compressed and shaped into a blank by means of a pressing tool, and the fact that the blank is subsequently punched out.

According to one preferred additional development of the method for manufacturing a tool carrier, a grinding or polishing tool or a blank, several layers are, after being sprayed, bonded together in a sandwich-like fashion such that a basic element is formed.

In the method for manufacturing a tool carrier, a grinding or polishing tool or a blank, it is particularly advantageous that the spraying process be carried out with a binder that is heated to a temperature between 100 and 200° C., preferably 150° C.

The method for manufacturing a tool carrier, a grinding or polishing tool or a blank is preferably carried out in such a way that the compressing process takes place at room temperature. Alternatively, it may be practical to carry out the compressing process at a temperature between 100 and 200° C.

For the method for manufacturing a tool carrier, a grinding or polishing tool or a blank, it is especially preferred that the blank be hardened for one to two days.

According to one preferred additional development of the method for manufacturing a tool carrier, a grinding or polishing tool or a blank, the fiber mat has a weight of approximately 1100–1500 g/m$^2$ and a thickness of approximately 2.5–4 mm in the compressed state.

According to another advantageous embodiment of the method for manufacturing a tool carrier, a grinding or polishing tool or a blank, the mat-like basic elements are needled before they are sprayed. The term needling refers to needles acting upon the mat such that its surface is broken open.

According to another additional development of the method for manufacturing a tool carrier, a grinding or polishing tool or a blank, the compressing process is carried out with a pressure between 15 and 35 bar.

In a fiber-reinforced rotationally symmetrical tool carrier that can be separably connected to a rotary drive and is provided with a tool receptacle surface for receiving at least one grinding and/or polishing element, the invention proposes that the fiber reinforcement consist at least partially of natural fibers.

Accordingly, the invention proposes that the tool carrier of the previously described material processing tool be manufactured at least partially from natural fibers.

In addition, a rotationally symmetrical blank for being additionally processed into a tool carrier according to the invention is manufactured from a fiber mat that consists at least partially of natural fibers and contains a binder for the natural fibers. Advantageous additional developments of the invention are disclosed in the dependent claims.

One significant advantage of the invention can be seen in the fact that the tool carrier of the material processing tool is no longer manufactured from plastic, but rather to a significant degree from regrowing raw materials.

This results in a significantly easier disposal. If an incineration process is used, the carbon dioxide generated is, for example, practically compensated by utilizing regrowing raw materials. In addition, other disposal options may be considered, for example, composting.

According to the invention, it was surprisingly determined that tool carriers manufactured from materials with natural fibers have superior thermal and mechanical properties. Another positive aspect of the invention is that natural fiber materials can today be purchased and processed relatively inexpensive.

The tool carrier or the initially described objects have particularly advantageous mechanical and thermal properties if the fiber reinforcement is stabilized with a binder. The binder may consist of a customary binder that, for example, is available in the form of a suspension or a solid powder or granulate. Single-component or multi-component binders may be utilized. Organic or inorganic binders may be considered, for example, phenol resins, styrene resins, polycarbonates or polyolefins, in particular, polypropylene. A woven fiber fabric such as a knitted hemp, flax and/or sisal fabric that contains a solid binder can be compressed into the final shape under increased pressure and elevated temperature. During this process, the binder melts and is distributed in the woven fiber fabric such that a product with high stability and resistance to tearing is obtained. The natural fiber content may lie between 50% and 85%, preferably between 70% and 80%.

In another preferred embodiment, the tool carrier is entirely manufactured from natural materials. This allows a particularly simple disposal. For example, cellulose materials may be used as binders in this case.

Preferred embodiments of the tool carrier are characterized by the fact that the natural fibers consist of one or more of the materials hemp, flax or sisal.

Today, these materials are agriculturally produced in large quantities and consequently relatively inexpensive. In addition, they have favorable processing and stability properties.

In one particularly preferred embodiment, the tool carrier is manufactured from a granulate that consists of natural fibers and a binder, preferably polypropylene. The granulate can be produced in a particularly simple and inexpensive fashion. The grains of the granulate are melted and injected into a corresponding mold, e.g., as known from plastic injection molding. In this case, a particularly suitable mixture of the granulate respectively consists of 50% natural fibers and polypropylene.

Another preferred additional development of the material processing tool is characterized by the fact that the grinding and/or polishing element also is manufactured at least partially from natural fibers. This is also advantageous with respect to proper disposal of the worn-out material processing tool.

BRIEF DESCRIPTION OF THE DRAWINGS

The invention is described in greater detail below with reference to embodiments that are schematically illustrated in the figures. The figures show.

DETAILED DESCRIPTION OF THE INVENTION

Figure 1:
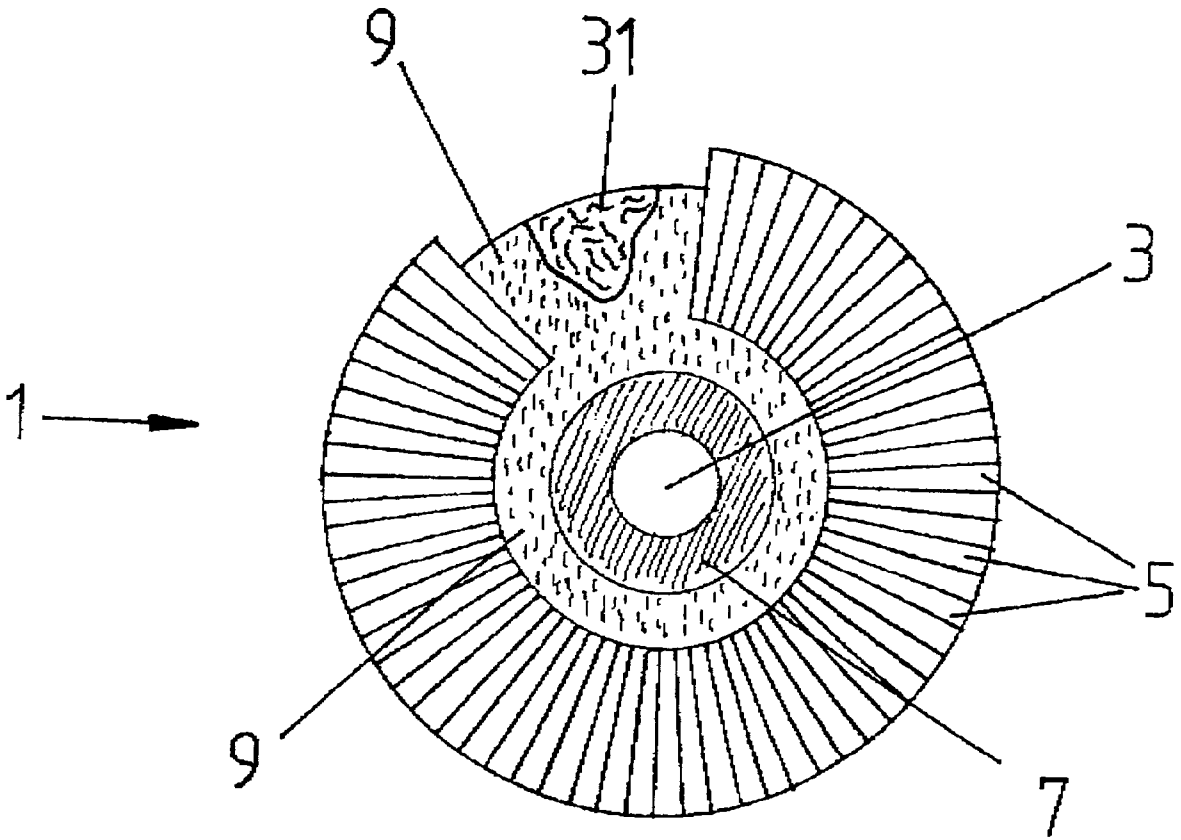
FIG. 1, a partially sectioned top view of a fan-type grinding machine.

FIG. 1 shows a fan-type grinding wheel 1 that consists of a tool carrier 7 and (lamellar) grinding elements 5 arranged thereon in a fan-like fashion. The tool carrier 7 also has a circular shape, wherein only a small segment of the outer edge of the tool carrier 7 is visible in this figure. An opening 3 is arranged in the center of the circular tool carrier 7 in order to connect the fan-type grinding wheel 1 to a rotary drive. The tool carrier 7 is manufactured from a hemp/polypropylene granulate. The natural fibers 31 are schematically illustrated in FIG. 1. The tool carrier 7 has a tool receptacle surface 9 on which a series of grinding elements 5 are arranged in a fan-like fashion. However, the grinding elements 5 were omitted in a small segment in this figure.

Figure 2:
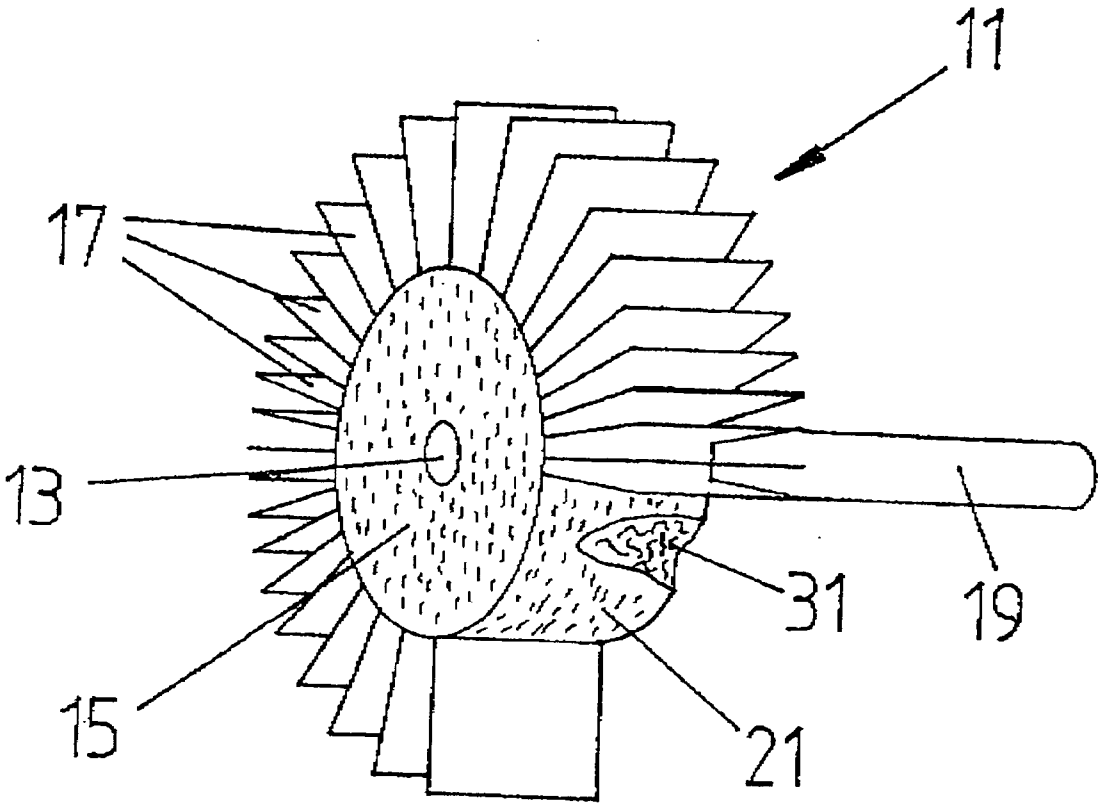
FIG. 2, a partially sectioned perspective representation of a grinding wheel that is also referred to as a mop wheel.

FIG. 2 shows a so-called mop wheel 11 that contains a cylindrical tool carrier 15 with radially arranged (lamellar) grinding elements 17. In the embodiment shown, an axle 19 is centrally inserted into the tool carrier 15 in order to connect the mop wheel 11 to a drive. The tool receptacle surface 21 consists of the surface area of the cylinder in this embodiment, wherein the grinding elements 17 are arranged on the surface area and radially protrude from the tool carrier 15. The tool carrier 15 is also manufactured from a natural fiber/binder granulate. The grinding elements 17 were omitted in a segment of the circular cylinder in order to illustrate the tool receptacle surface 21. Part of this figure is also illustrated in a sectioned fashion, and the natural fibers 31 are schematically indicated.

Figure 3:
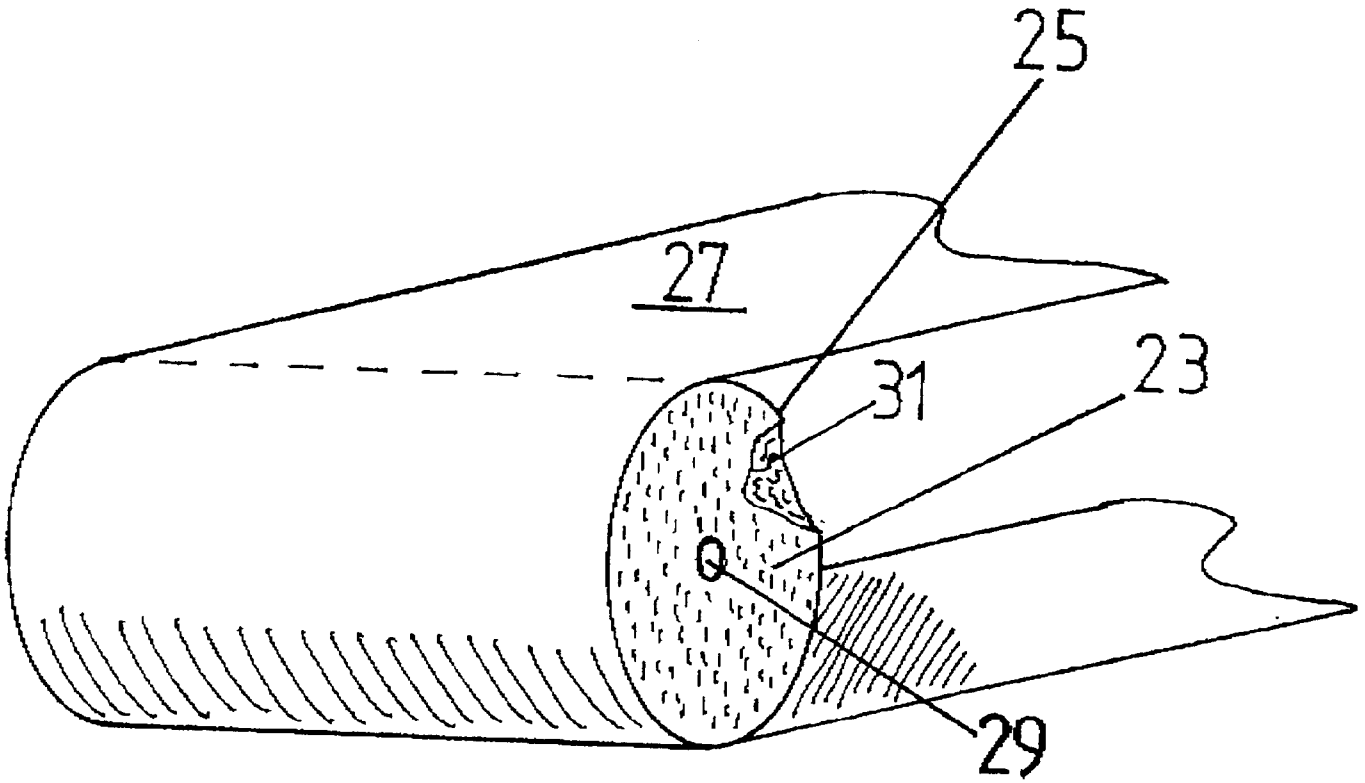
FIG. 3, a partially sectioned perspective presentation of a cylindrical tool carrier with an endless grinding belt.

FIG. 3 shows a tool carrier 23 of cylindrical design, wherein an endless grinding or polishing belt rolls on the tool receptacle surface 25 of the tool carrier while the tool is used. The tool carrier 23 contains an axial opening 29 for producing the connection with a (not-shown) rotary drive. Part of the tool carrier 23 which is manufactured from a natural fiber/binder granulate is also illustrated in a sectioned fashion in FIG. 3, and the natural fibers 31 are schematically indicated. In contrast to the embodiments shown in FIGS. 1 and 2, the grinding element, i.e., the endless grinding belt 27, is received by the tool receptacle surface 25 in the form of a non-positive connection in this embodiment.

The lamellar grinding elements 5, 17 shown in FIGS. 1 and 2 consist of a woven fabric of natural fibers, for example, hemp, sisal or flax, wherein the working side of the woven fabric contains abrasive grain. The woven grinding fabric is conventionally impregnated, for example, with phenol resins, and sprayed, e.g., with urea, such that a superior adhesion of the abrasive grain is achieved.

The grinding belt 27 in the embodiment according to FIG. 3 analogously consists of a woven fabric of natural fibers that contains abrasive grain.

Figure 4:
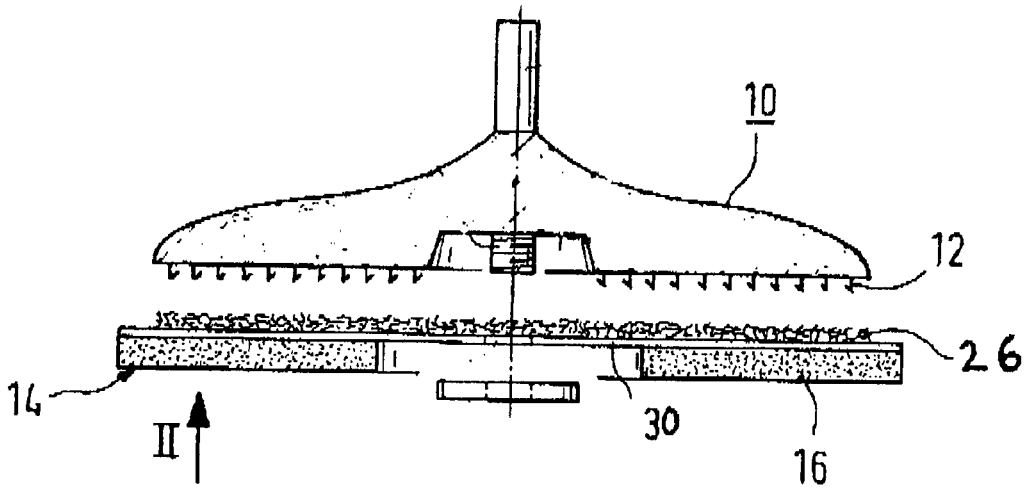
FIG. 4, a longitudinal section through a grinding tool.
Figure 5:
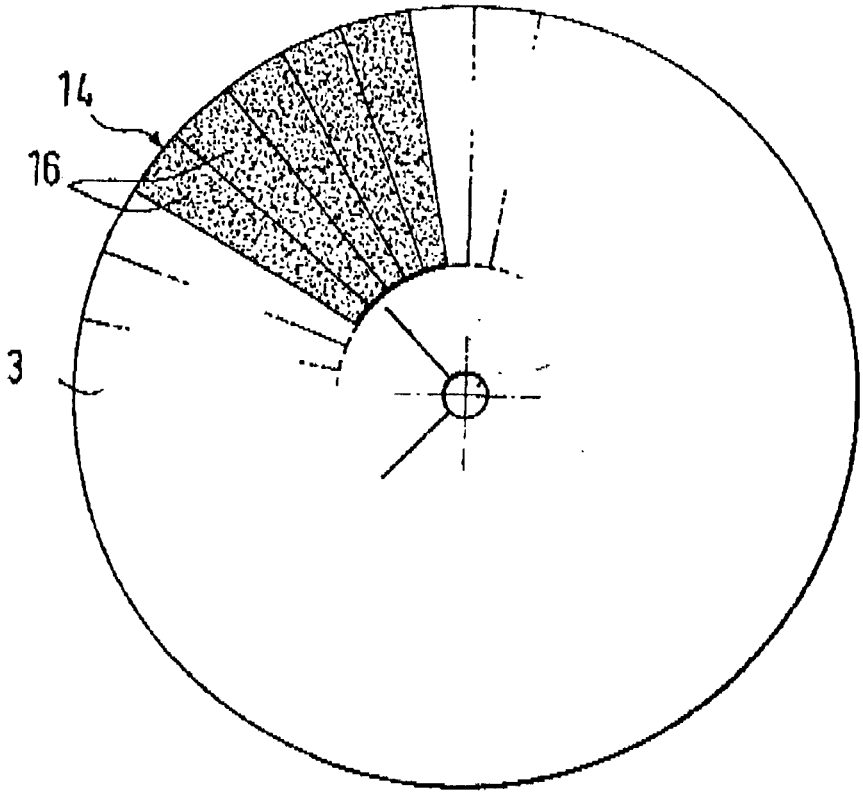
FIG. 5, a view of a woven fabric carrier that is equipped with lamellar grinding elements and forms part of the grinding tool shown in FIG. 4.

In the embodiment according to FIGS. 4 and 5, the grinding tool contains a disk-shaped tool carrier 10, a separate woven fabric carrier 26 that can be separably attached to the tool carrier 10 and radially aligned lamellar grinding elements 16 arranged thereon. The raw material for the tool carrier 10, the woven fabric carrier 26 and the lamellar grinding elements 16 respectively consists of natural fibers that are, depending on the intended use, processed and adapted differently.

The end face of the tool carrier 10 is provided with microscopic hooks 12 that are also referred to as Velcro-type hooks and cooperate with a section 30 consisting of loose threads so as to form a so-called Velcro fastener. Consequently, the woven fabric carrier 26 can be easily attached to and detached from the tool carrier. On the side of the woven fabric carrier 26 which is situated opposite the section 30, the natural fibers are impregnated such that the adhesive connection with the lamellar grinding elements 16 is improved.

The woven fabric carrier 26 that is equipped with the lamellar grinding elements 16 consequently represents an object that, after the lamellar grinding elements 16 are worn out, is discarded and replaced with a new woven fabric carrier containing unused lamellar grinding elements 16. However, the tool carrier 10 can be reused in order to preserve resources.

FIG. 5 shows one phase of the method for manufacturing disk-shaped tools 60. A plate-shaped basic element 61 is produced from a pulp consisting of natural fibers and a binder, as well as abrasive grain that is homogeneously distributed therein. This basic element is subsequently compressed under increased pressure and elevated temperature, wherein the blanks 62 of tools are shaped and compressed adjacent to one another. The blanks 62 already have the shape and stability of the final product. The blanks 62 are punched out in a subsequent punching process. Due to the embedded abrasive grain, these tools may, for example, be used as cutting-off wheels.

Tools manufactured in this fashion may be additionally or alternatively provided with abrasive grain on their end face after the punching process such that they can be used for grinding, rough-grinding or polishing surfaces.

Figure 6:
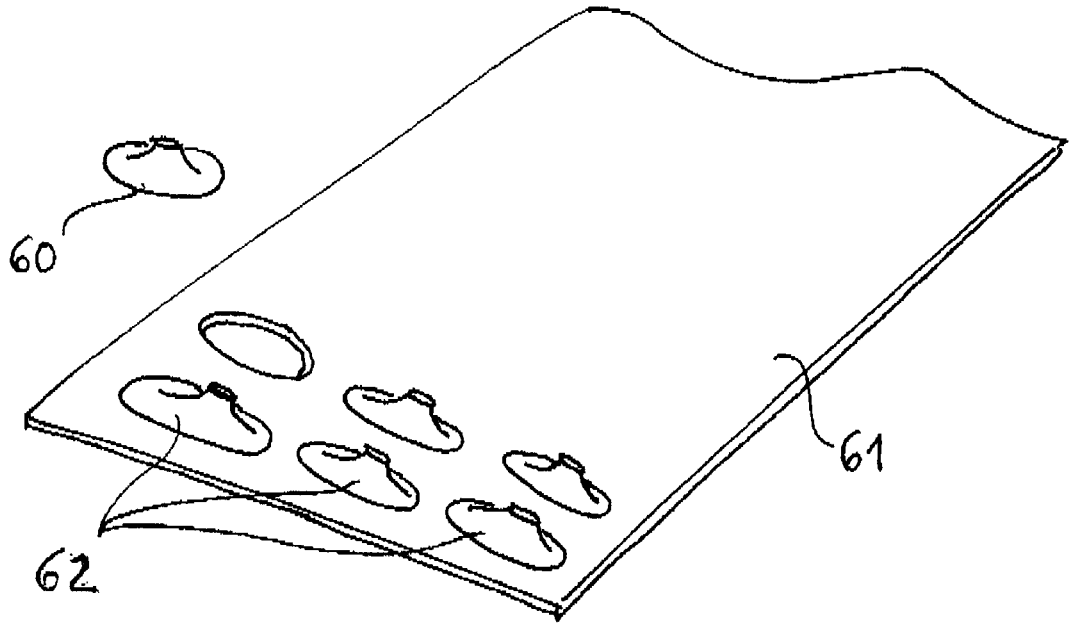
FIG. 6, a perspective representation of a plate-shaped basic element for manufacturing tools or tool carriers.

Tool carriers according to FIGS. 1 and 4 may be manufactured analogous to FIG. 6.

Figure 7:
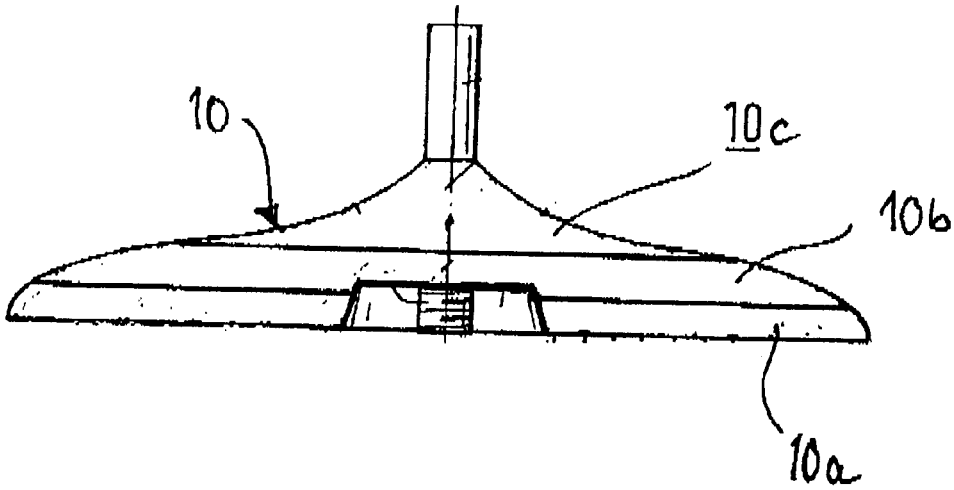
FIG. 7, a longitudinal section through another grinding tool.

FIG. 7 shows a method for manufacturing a tool carrier, a grinding or polishing tool or a blank, wherein several—in this case three—layers 10*a*, 10*b*, 10*c* consisting of fiber mats are bonded together in a sandwich-like fashion such that a basic element 10 is formed. The individual layers 10*a*, 10*b*, 10*c* may be bonded to one another in the non-compressed state and then compressed and punched out collectively. Alternatively, already compressed and punched out layers may be subsequently bonded to one another. Depending on the intended use, the individual layers 10*a*, 10*b*, 10*c* may be manufactured from different fiber materials. Abrasive grain may be arranged between the individual layers.

What is claimed:

1. A rotationally symmetrical tool carrier which can be separably connected to a rotary drive, with a tool receptacle surface for receiving at least one grinding and/or polishing element, with a fiber reinforcement that comprises at least partially of natural fibers, and with a binder for stabilizing the natural fibers, wherein the binder consists of one of the materials polyurethane, polypropylene, phenol resin, epoxy resin or biological polymer.

2. The tool carrier according to claim 1, wherein the binder comprises of lignin.

3. The tool carrier according to claim 1, wherein the binder is based on corn starch.

4. The blank for being additionally processed into a tool carrier, a tool, a woven fabric carrier or a woven fabric according to claim 1, wherein the blank is manufactured from a fiber mat that comprises at least partially of natural fibers and contains a binder for the natural fibers.

5. The blank according to claim 4, wherein the blank is manufactured from at least two fiber mats that comprises at least partially of natural fibers and contain a binder for the natural fibers, and by the fact that the fiber mats are placed on top of one another in a sandwich-like fashion and bonded to one another.

6. The blank according to claim 4, wherein abrasive grain is applied onto the surfaces of the fiber mats before the bonding process.

7. A method for manufacturing a tool carrier, a woven fabric carrier, a woven fabric, a grinding or polishing tool or a blank according to claim 1, wherein a pulp is produced from natural fibers and a binder, plate-shaped basic elements are produced from the pulp, the basic elements are compressed and shaped by means of a pressing tool in such a way that several blanks are produced adjacent to one another, and the blanks are subsequently punched out.

8. The method according to claim 7, wherein the abrasive grain is added to and homogeneously distributed in the pulp such that the abrasive grain is uniformly distributed in the objects manufactured therefrom.

9. The method for manufacturing a tool carrier, a woven fabric carrier, a woven fabric, a grinding or polishing tool or a blank according to claim 1, wherein a pulp is produced from natural fibers, by the fact that mat-like basic elements are produced from the pulp, by the fact that the basic elements are sprayed with a binder, by the fact that the basic elements are compressed and shaped into a blank by means of a pressing tool, and by the fact that the blank is punched out.

10. The method for manufacturing a tool carrier, a grinding or polishing tool or a blank according to claim 9, wherein several layers are, after being sprayed, bonded together in a sandwich-like fashion such that a basic element is formed.

11. The method for manufacturing a tool carrier, a grinding or polishing tool or a blank according to claim 9, wherein the spraying is carried out with a binder that is heated to a temperature between 100 and 200° C., preferably 150° C.

12. The method for manufacturing a tool carrier, a grinding or polishing tool or a blank according to claim 9, wherein the compressing process takes place at room temperature.

13. The method for manufacturing a tool carrier, a grinding or polishing tool or a blank according to claim 9, wherein the blank is hardened for one to two days.

14. The method for manufacturing a tool carrier, a grinding or polishing tool or a blank according to claim 9, wherein the fiber mat has a weight of approximately 1100–1500 g/m$^2$ and a thickness of approximately 2.5–4 mm in the compressed state.

15. The method for manufacturing a tool carrier, a grinding or polishing tool or a blank according to claim 9, wherein the mat-like basic elements are subjected to a needling process before being sprayed.

16. The method for manufacturing a tool carrier, a grinding or polishing tool or a blank according to claim 9, wherein the compressing process is carried out with a pressure between 15 and 35 bar.

17. The method for manufacturing a tool carrier, a grinding or polishing tool or a blank according to claim 16, wherein the compressing process takes place at a temperature between 100 and 200° C.

18. A woven fabric carrier for woven grinding and polishing fabrics, comprising a woven fabric carrier manufactured at least partially from natural fibers.

19. The woven fabric carrier according to claim 18, wherein the binder comprises of lignin.

20. The woven fabric carrier according to claim 18, wherein the binder is based on corn starch.

* * * * *